United States Patent [19]

Ganser et al.

[11] Patent Number: 4,839,560

[45] Date of Patent: Jun. 13, 1989

[54] HEATABLE ELECTRODE FOR HIGH-PRESSURE GAS DISCHARGE LAMPS

[75] Inventors: Hans G. Ganser, Stolberg; Ralf Schäfer, Aachen; Hans P. Stormberg, Stolberg, all of Fed. Rep. of Germany

[73] Assignee: U.S. Philips Corporation, New York, N.Y.

[21] Appl. No.: 707,322

[22] Filed: Mar. 1, 1985

[30] Foreign Application Priority Data

Mar. 8, 1984 [DE] Fed. Rep. of Germany ..... 3408431

[51] Int. Cl.[4] ..... H01J 61/06

[52] U.S. Cl. ..... 313/628; 313/631

[58] Field of Search ..... 313/578–580, 313/628, 631, 632, 344

[56] References Cited

U.S. PATENT DOCUMENTS

| | | | |
|---|---|---|---|
| 1,157,995 | 10/1915 | Mackay | 313/578 |
| 3,519,872 | 7/1970 | Ward | 313/601 |
| 4,398,123 | 8/1983 | Tsuchihashi et al. | 315/46 |

*Primary Examiner*—David K. Moore
*Assistant Examiner*—Sandra L. O'Shea
*Attorney, Agent, or Firm*—Brian J. Wieghaus; David R. Treacy

[57] ABSTRACT

An electrode having a self-supporting cylindrical open coil of tungsten or molybdenum wire having a lead wire of tungsten or molybdenum passed coaxially through the coil and connected thereto. The turns of the coil engage each other. The central lead wire has a smaller diameter than the coil wire, this thin portion extending to a location just before the outermost turn of the coil.

4 Claims, 1 Drawing Sheet

HEATABLE ELECTRODE FOR HIGH-PRESSURE GAS DISCHARGE LAMPS

BACKGROUND OF THE INVENTION

The invention relates to a heatable electrode for igniting and reigniting high-pressure gas discharge lamps; and more particularly to such an electrode which comprises a self-supporting cylindrical open coil of tungsten or molybdenum wire having a metal wire of tungsten or molybdenum passed coaxially through the coil and connected thereto. Such electrodes serve to reduce the ignition voltage of gas discharge lamps; the heating of the electrode can either be maintained during the whole operation of the lamp or be switched off after ignition of the lamp.

In an electrode of this kind for the hot reignition of 400 W mercury vapor high-pressure lamps known from DE OS No. 3106201, which corresponds to U.S. Pat. No. 4,398,123 the coil consists of a comparatively thick wire and its individual turns are pulled far apart so that they are not in contact with each other. At the outermost turn, the coil wire passes without variation in cross-section into the metal wire passed coaxially through the coil. For preheating, the whole electrode is heated uniformly. This requires comparatively high currents for the thick coil wire, which currents can be allowed to flow through the seals of the lamp ends in high-power lamps only.

U.S. Pat. No. 3,519,872 discloses a high-pressure gas discharge lamp having an electrode which is cylindrically wound onto a tungsten rod, and has an outer end which is connected a heating coil consisting of thin wire. When an ignition pulse is applied to the lamp after this electrode has been preheated, the discharge arc first starts at the heating coil and then travels to the actual cylindrically wound electrode. This requires a geometry of the electrode arrangement that has to be accurately maintained. Moreover, there is a risk of the discharge arc remaining on the thin heating coil for too long a time and thus leading to its destruction.

The known preheatable electrodes are in addition not suitable for so-called miniaturized gas discharge lamps, i.e. gas discharge lamps consuming a power of up to about 70 W, because of the comparatively large electrode dimensions.

SUMMARY OF THE INVENTION

The object of the invention is; to provide a heatable electrode for high-pressure gas discharge lamps, which is of compact construction, requires only little heating power and cannot be damaged by the discharge arc produced upon ignition.

According to the invention, this object is achieved in a heatable electrode of the kind mentioned in the opening paragraph in that the turns of the coil engage each other, the metal wire passing coaxially through the coil has a smaller diameter than the coil wire, and this thin metal wire terminates before the outermost turn of the coil.

Since in this case the central metal wire passed through the coil has a smaller diameter than the coil wire, i.e. a higher electrical resistivity than the coil, the central wire is strongly heated when preheating this electrode and is passed to a redhot state. This effect is further promoted in that the turns of the coil engage each other so that the electrical resistance of the coil is negligible with respect to that of the metal wire passed through the coil. Especially with a small coil diameter, the heating of the metal wire present in the coil leads to a heating of the outermost turn of the coil due to heat conduction so that this turn also becomes redhot. Fot this reason, upon the subsequent ignition, the discharge arc starts at the coil and not at the thin metal wire because the latter terminates before the outermost turn of the coil.

Such a heatable electrode is particularly suitable for miniaturized gas discharge lamps, especially metal halogenide discharge lamps.

In an embodiment of the electrode according to the invention which is favorable with respect to its manufacture, the metal wire is independent of this coil wire and is clamped at its end on the side of the coil between two turns of the coil. Efficaciously, the metal wire is clamped at the area of the outer turns of the coil, especially between its second and third turns. The metal wire may also be secured to the coil by spotwelding.

In a further advantageous embodiment of the electrode according to the invention, the metal wire has the form of an extending part of the coil wire and is etched to a smaller diameter to a location just before the outermost turn of the coil. This has the advantage that the coil and the metal wire are made in one piece.

In order that the invention may be readily carried out, it will be described more fully with reference to the accompanying drawing.

DESCRIPTION OF THE PREFERRED EMBODIMENTS

Figure 1:
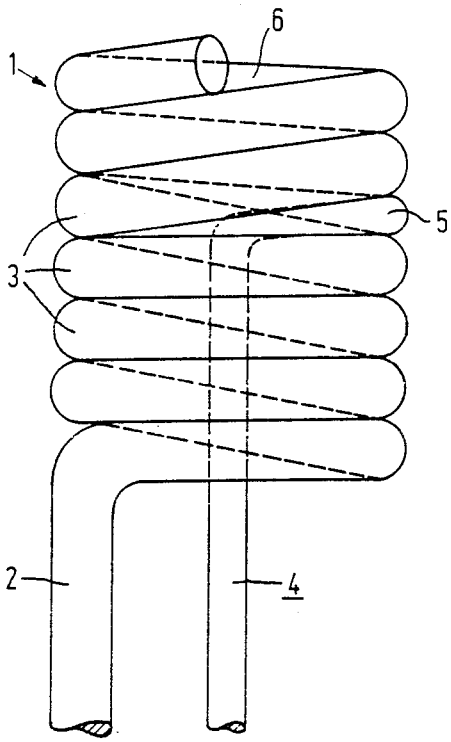
FIG. 1 is a side elevation of a heatable electrode comprising a self-supporting cylindrical open coil.
Figure 2:
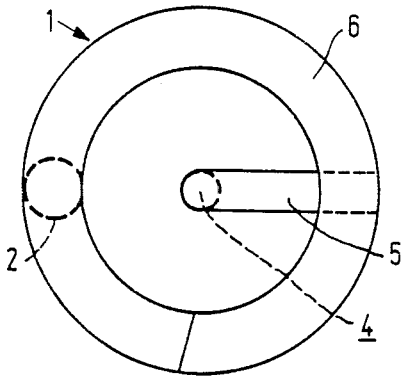
FIG. 2 is a plan view of the electrode shown in FIG. 1.

The electrode shown in FIGS. 1 and 2 comprises a self-supporting cylindrical open coil 1 of tungsten or molybdenum wire 2. The individual turns 3 of the coil 1 lie close to each other. A metal wire 4 of, for example, tungsten is passed coaxially through the coil 1. This wire 4 has a smaller diameter than the coil wire 2. The metal wire 4 passed axially through the coil 1 is bent at near its outer end and, as the case may be, flattened and is clamped between two turns 3 of the coil 1, more particularly between its second and third turns. The outermost turn is designated by reference numeral 6.

Figure 3:
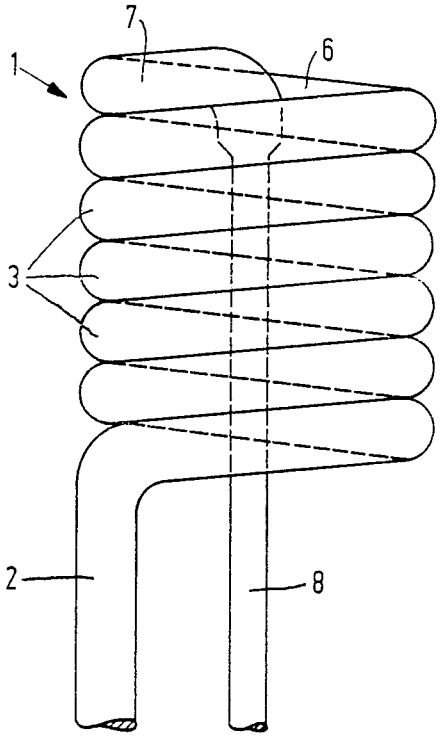
FIG. 3 shows the side elevation of another heatable electrode comprising a self-supporting cylindrical open coil.
Figure 4:
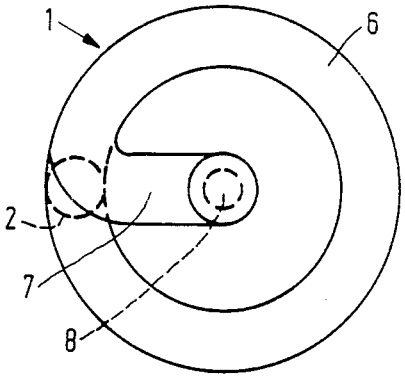
FIG. 4 is a plan view of the electrode shown in FIG. 3.

The electrode shown in FIG. 3 and 4 is constructed in a manner similar to that of the electrodes shown in FIGS. 1 and 2. However, in this case, the coil wire end 7 of the outermost turn 6 is bent backwards and is passed coaxially through the coil 1 as an extending part of the coil wire 2. The metal wire 8 present inside the coil 1, which initially had the same diameter as the coil wire 2, has then been etched to a smaller diameter to a location just before the outermost turn 6 of the coil 1.

When the electrodes described are heated, first the thin metal wire 4 or 8, respectively, is heated. Due to heat conduction, the outer turn 6 of the coil 1 is then heated. Upon ignition of a high-pressure gas discharge lamp provided with such electrodes, the discharge arc therefore starts immediately at the coil 1. Thus destruction of the metal wire 4 and 8, respectively, is avoided.

In pratical experiments with such electrodes for 30 W and 40 W metal halide discharge lamps, respectively, the coil consisted of five turns of tungsten wire having a wire diameter of 180 μm and an inner diameter of 500 μm. In an electrode corresponding to that shown in FIGS. 1 and 2, a tungsten wire of 50 to 100 μm diameter was clamped between the second and third turns of the coil.

Such electrodes were incorporated in envelopes of miniaturized high-pressure gas discharge lamps, which have a volume of approximately 0.25 $cm^3$ and an electrode gap of approximately 0.5 cm. The envelopes were filled with 1 mg of Hg and a rare gas at a pressure of 200 torr as well as with different metal halide compounds. When the electrodes are heated to approximately 3000 K, these lamps ignite without an ignition pulse at a supply voltage of 220 V. On the contrary, a few lamps without preheating could not be ignited even with ignition pulses of 4.5 kV.

When such lamps are filled only with Hg and a rare gas, these lamps can be reignited without an ignition pulse at approximately 220 V also in the hot state, i.e. immediately after being switched off from the stationary condition. In lamps containing, for example, iodine (NaJ, $HgJ_2$ etc.), this immediate reignition in the hot state could not be attained, it is true, but also in this case the time between the instants of switching-off and reignition was considerably shortened. With heated electrodes, a reignition at a supply voltage of 220 V was possible after approximately 20 seconds without an additional ignition pulse.

What is claimed is:

1. A heatable electrode for igniting and reigniting high-pressure gas discharge lamps, comprising a self-supporting cylindrical open coil of tungsten or molybdenum wire, and a metal lead wire of tungsten or molybdenum which passes coaxially through the coil and is connected thereto, characterized in that the turns of the coil engage each other, the lead wire has a smaller diameter than the coil wire, and the lead wire terminates before the outermost turn of the coil.

2. An electrode as claimed in claim 1, characterized in that the lead wire is independent of the coil wire and has an end clamped at the side of the coil between two turns of the coil.

3. An electrode as claimed in claim 2, characterized in that the lead wire is clamped between the second and third outer turns of the coil.

4. An electrode as claimed in claim 1, characterized in that the metal wire is formed as an extension of the coil wire and is etched to a smaller diameter than the coil wire, to a location just before the outermost turn of the coil.

* * * * *